United States Patent [19]

Steinhilber

[11] Patent Number: 4,986,193

[45] Date of Patent: Jan. 22, 1991

[54] DESK TOP FOR STAND-UP AND WRITING DESK

[76] Inventor: Helmut Steinhilber, Sonnenbergstrasse 40, 6052 Hergiswil, Switzerland

[21] Appl. No.: 424,349

[22] Filed: Oct. 19, 1989

[30] Foreign Application Priority Data

Oct. 19, 1988 [DE] Fed. Rep. of Germany ..... 3835573

[51] Int. Cl.[5] ..... A47B 17/00

[52] U.S. Cl. ..... 108/27; 108/1

[58] Field of Search ..... 108/27, 87, 55.1, 1

[56] References Cited

U.S. PATENT DOCUMENTS

| | | | |
|---|---|---|---|
| 1,314,060 | 8/1919 | Hagerstrom | 108/27 |
| 2,687,932 | 8/1954 | Hokanson | 108/1 |
| 2,705,820 | 4/1955 | Torrence | 108/27 X |
| 3,212,755 | 10/1965 | Liss et al. | 108/27 X |
| 3,869,106 | 3/1975 | Gregov | 108/27 X |
| 4,117,782 | 10/1978 | Cahill | 108/27 |

*Primary Examiner*—Peter A. Aschenbrenner

*Attorney, Agent, or Firm*—Mason, Fenwick & Lawrence

[57] ABSTRACT

An inclined desk top (12) for combined stand-up and writing desks has a strip on the edge facing the user, projecting above the surface of the desk top. The strip is elastically yielding.

14 Claims, 2 Drawing Sheets

DESK TOP FOR STAND-UP AND WRITING DESK

The invention relates to a desk top for stand-up and writing desks.

Stand-up and writing desks are used as working desks and lecterns To keep sheets of paper or other working documents from sliding off the desk top, while sloping for use as a lectern the desk top has a strip at the lower edge thereof facing the user. In known desk tops, this strip protrudes only slightly above the surface of the desk top, so that it does not reliably ensure that sheets of paper laid on the desk top will be held by the strip. This is especially problematical when a tall stack of sheets is set down. An increased height for the strip would be perceived as uncomfortable because the strip presses into the user's arm when he or she leans on the desk top when working at the desk.

The goal of the present invention is to provide a desk top with a strip at the edge of sufficient height reliably to hold even stacks of sheets without the strip irritating the user.

Advantageous embodiments of the invention are described in the subclaims.

According to the invention, the strip at the edge of the desk top is elastically yielding, so that it gives way to the resting arm of the user. The strip can project to a sufficient height of 15 mm, for example, above the surface of the desk top so as to hold reliably tall stacks of paper, writing instruments, or other working materials. When the user rests his arm on the strip, the segment or portion of the strip beneath the arm latter yields elastically so that the arm essentially rests on the desk top and the strip is not perceived as irritating.

The strip in some embodiments consists of an elastically yielding material, for example, a foamed plastic which can be compressed by the pressure of the user's arm and resumes its original shape when released.

In other embodiments, the strip is of a rigid there is resilient means to material and provide an elastic springing action so that the strip can be pressed downward perpendicularly to the surface of the desk top.

In a strip made of elastically yielding material, the strip is deformed and pressed downward only in the area in which the user's arm is in contact with it. The other areas of the strip remain undeformed and hold the working materials resting on the desk top. In the case of a strip made of rigid material, the strip is preferably divided lengthwise into a plurality of segments which are movable separately and sprung separately. Therefore, only the segments of the strip upon which the user's arm is resting will be pressed down. The other segments will retain their normal positions in order to support the working materials resting on the desk top.

The strip can be mounted in a groove provided in the surface of the desk top so that the strip can be pressed completely down into this groove until its upper surface is flush or nearly flush with the surface of the desk top. In the case of a rigid strip, it is also possible to locate it in front of the edge of the desk top facing the user and to fasten it pivotably by springs to the underside of the desk top.

The invention will now be described in greater detail with reference to the embodiments shown in the drawing.

FIG. 1 a perspective view of a desk top with strip; in accordance with the present invention FIG 2 is a partial transverse and section through FIG. 1 to FIG. 3 is a partial transverse section of a second embodiment;

The stand-up desk has a desk top 12 supported by a post 10, said top 12 being sloped toward the user. On the edge of desk top 12 facing the user, a strip 14 is provided which extends over the entire width of desk top 12 and projects upward above the surface of desk top 12.

Figure 1:
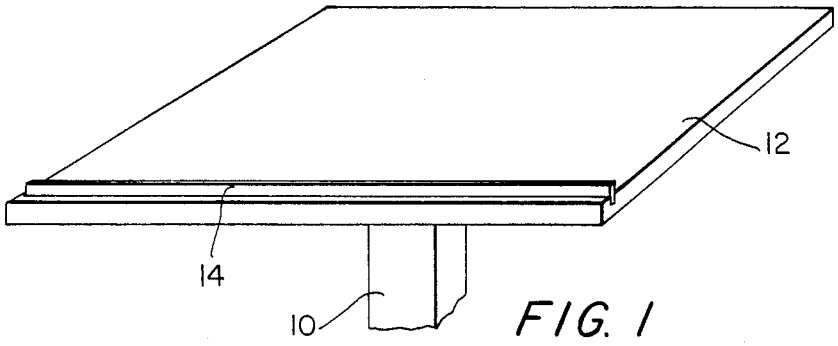
Figure 2:
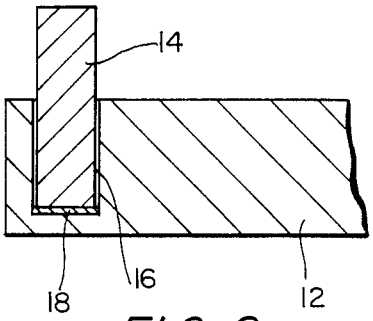

In the embodiment in FIG. 2, adjacent to the edge of desk top 12 facing the user, a groove 16 is provided in its surface which extends over the entire width of desk top 12. Strip 14 is of rectangular cross-section and of elastically deformable foamed plastic. Strip 14 is fitted into groove 16 and glued to the bottom of the groove 16 by means of a suitable adhesive 18. Because of the elastic deformability of strip 14, a portion thereof can be forced into groove 16 by the arm of the user resting upon it. When the load on strip 14 is released, its elasticity causes the depressed portion to resume its original shape.

Figure 3:
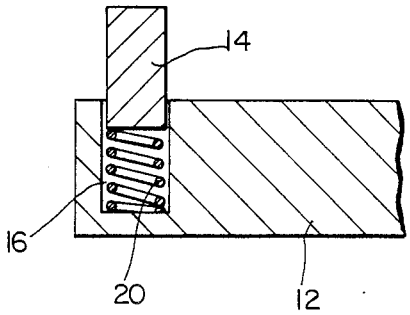

In the embodiment in FIG. 3, strip 14 is composed of a rectangular cross-section, made of a rigid material, preferably plastic. Extending lengthwise over the entire width of desk top 12, strip 14 is subdivided into individual segments approximately 5 to 10 cm long. Strip 14 is sunk into groove 16 in desk top 12, with spring elements 20 being provided between the lower edge of strip 14 and the bottom of groove 16, said elements 20 resiliently supporting strip 14. Separate spring elements 20 are associated with each segment of strip 14, so that the individual segments of strip 14 can be forced independently of one another into groove 16 against the force of spring elements 20. The heights of strip 14 and spring elements 20 are selected so that strip 14 can be pushed completely or nearly completely into desk top 12. Spring elements 20 are shown in FIG. 3, only as examples, as coil compression springs. Any conventional compression spring elements known to the individual skilled in the art may be used.

Figure 4:
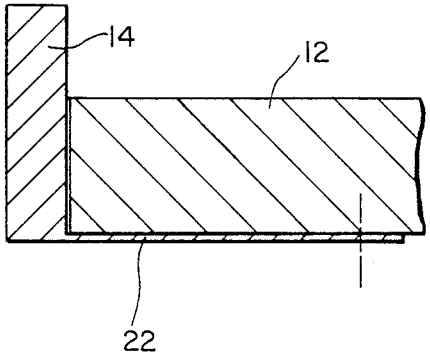
FIG. 4 is a partial transverse section in a third embodiment.

In the embodiment shown in FIG. 4, strip 14 is located in front of the edge of desk top 12 facing the user. Strip 14 is made of a rigid material and is subdivided into individual segments as in the embodiment shown in FIG. 3. Strip 14 fits under desk top 12 separately for each segment with a leg 22 designed as a leaf spring. Leg 22 is fastened by the end thereof opposite strip 14 to the underside of desk top 12. If strip 14 is made of metal, leg 22, functioning as a leaf spring, can be made integral with strip 14 as shown in FIG. 4. If strip 14 is made of a rigid plastic, a separate leaf spring made of spring steel is used for leg 22. When a segment of strip 14 is pushed down by the user's arm, leg 22 bends elastically and, after the load is removed, forces that depressed segments of strip 14 back into the normal position shown in FIG. 4.

Figure 5:
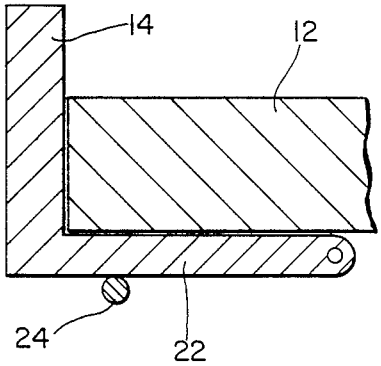
FIG. 5 is a partial transverse section of a fourth embodiment.
Figure 3A:
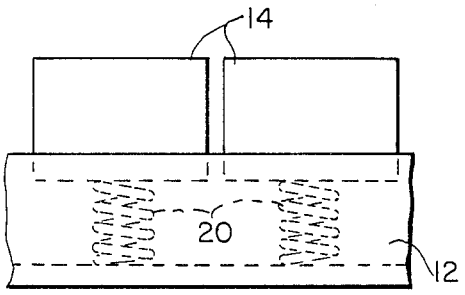
Figure 4A:
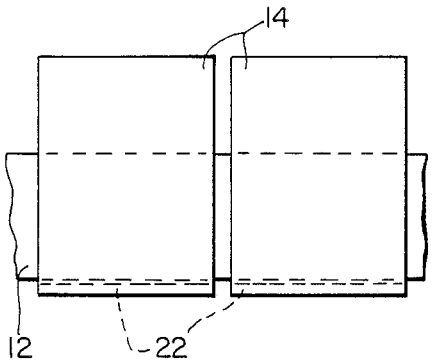
Figure 5A:
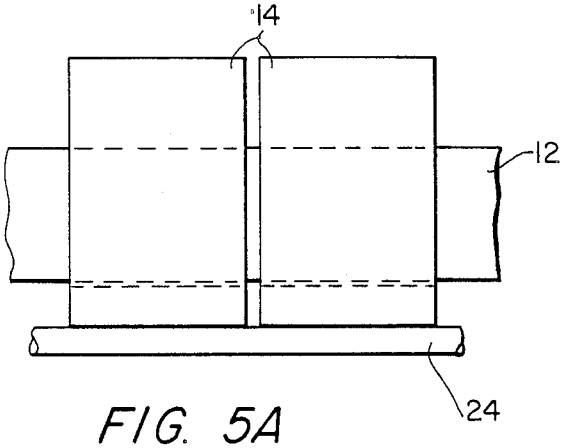

In the embodiment shown in FIG. 5, strip 14, similar to the embodiment shown in FIG. 4, is located in front of the user-side edge of desk top 12 and subdivided into individual segments which are made of a rigid material.

The leg 22 of each individual segment of strip 14, which leg fits under desk top 12, is integral with strip 14. At the end opposite strip 14, legs 22 are mounted pivotably to the underside of desk top 12 so that the segments of strip 14 can be individually swung downward by the superimposed arm of the user. Strip 14 is elastically held in the position shown in FIG. 5, in which it projects upward above the surface of desk top 12 be elastic spring elements 24. In FIG. 5 an elastic cord is used as the elastic spring element 24, said cord being tensioned on the underside of desk top 12 across its entire width, holding legs 22 of strip 14 so that they abut the underside of desk top 12.

Figure 6:
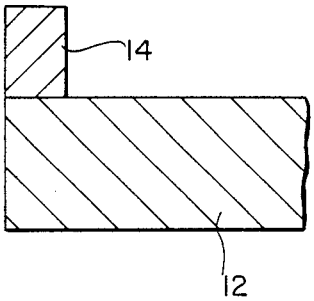
FIG. 6 is a partial transverse section of a fifth embodiment.
Figure 7:
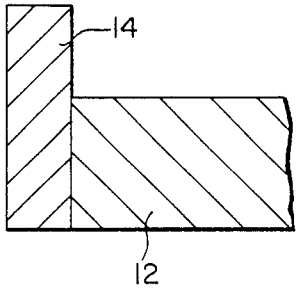
FIG. 7 is a partial transverse section of a sixth embodiment.

FIGS. 6 and 7 show the simplest embodiments of the strip. The strip, as in the embodiment shown in FIG. 2, is of rectangular cross-section and is made of an elastically deformable foamed plastic. In the embodiment in FIG. 6, strip 14 is glued or welded to the top surface of the edge of desk top 12 facing the user while in. In the embodiment shown in FIG. 7, strip 14 is glued and/or welded to the front edge of desk top 12 facing the user.

I claim:

1. A desk top for use while inclined comprising a lower edge facing the user and a top surface, and means for preventing material from sliding off said top surface of said desk top comprising:

a strip extending above said top surface and along said lower edge, and means for enabling only a lengthwise segment of said strip to be pushed downwardly upon engagement of the top thereof by the arm of a user and for resiliently urging said segment upwardly, the portions of the strip not engaged by the user's arm extending above said inclined top surface to retain material thereon.

2. The desk top of claim 1, wherein said enabling and urging means comprises said strip being of elastically deformable material.

3. The desk top of claim 2, and means for adhering said strip of elastically deformable material to said desk top.

4. The desk top of claim 3, wherein said adhering means adheres said strip to the top surface of the desk top.

5. The desk top of claim 3, wherein said adhering means adheres said strip to the lower edge of said desk top.

6. The desk top of claim 1, said strip being of foamed plastic.

7. The desk top of claim 1, said desk top having a groove in the upper surface of said desk top, said enabling and urging means being in said groove.

8. The desk top of claim 7, wherein said enabling and urging means comprises said strip being of elastically deformable material.

9. The desk top of claim 1, wherein said enabling and urging means comprises said strip being of individual segments of rigid material and resilient means engaging each said segment.

10. The desk top of claim 9, said desk top having a groove in the upper surface of said desk top, said segments and resilient means being in said groove.

11. The desk top of claim 9, wherein each said segment has a leg extending therefrom beneath said desk top.

12. The desk top of claim 11, said leg being resilient.

13. The desk top of claim 11, said leg being rigid and said urging means being an elastic cord.

14. An inclined desk top having an upper inclined surface and a lower edge, and means at the lower edge for preventing objects from sliding off said inclined desk top upper surface and for avoiding discomfort to a user having his arm on said desk top upper surface at the lower edge thereof comprising a strip at said lower edge and means for permitting a linear portion thereof to yield downwardly upon engagement by the arm of a user to enable the arm of the user to rest substantially on said upper surface and for resiliently urging said linear portion upwardly upon disengagement of the arm of the user from said strip, the portions of the strip not engaged by the user's arm extending above said upper surface.

* * * * *